US005732847A

United States Patent [19]

Caldi

[11] Patent Number: 5,732,847

[45] Date of Patent: *Mar. 31, 1998

[54] FOOD AND BEVERAGE HOLDER

[76] Inventor: Michel Caldi, 9 chemin de l'Aunay, 78550 Bazainville, France

[ * ] Notice: The term of this patent shall not extend beyond the expiration date of Pat. No. 5,624,052.

[21] Appl. No.: 448,335

[22] PCT Filed: Dec. 9, 1993

[86] PCT No.: PCT/FR93/01215

§ 371 Date: Jun. 9, 1995

§ 102(e) Date: Jun. 9, 1995

[87] PCT Pub. No.: WO94/13180

PCT Pub. Date: Jun. 23, 1994

[30] Foreign Application Priority Data

Dec. 9, 1992 [FR] France ..... 92 14848
Jun. 9, 1993 [FR] France ..... 93 06948

[51] Int. Cl.[6] ..... A47G 19/06

[52] U.S. Cl. ..... 220/575; 206/546; 206/549; 220/23.83; 294/146; D7/555

[58] Field of Search ..... 206/541, 546, 206/549, 561, 562, 564, 216, 217; 294/143, 144, 146, 159, 137, 160, 172; 215/393; 229/932; D7/501, 550, 553, 554, 543, 547, 549, 555; 220/507, 574, 575, 629, 23.83, 23.86, 528

[56] References Cited

U.S. PATENT DOCUMENTS

| | | | |
|---|---|---|---|
| D. 65,722 | 10/1924 | Bennett | D7/501 X |
| D. 160,688 | 10/1950 | Brock | D7/501 |
| D. 363,644 | 10/1995 | Wyatt et al. | D7/553 |
| D. 368,409 | 4/1996 | Schwartz | D7/549 X |
| 1,595,356 | 8/1926 | Moseman . | |
| 1,996,300 | 4/1935 | Lindsay | 294/143 |
| 2,101,401 | 12/1937 | Leppke . | |
| 2,107,381 | 2/1938 | Leppke . | |
| 2,240,020 | 4/1941 | Raiser . | |
| 2,561,022 | 7/1951 | Jones . | |
| 2,661,679 | 12/1953 | Van Guilder . | |
| 2,920,804 | 1/1960 | Minton . | |
| 3,027,037 | 3/1962 | Bronson . | |
| 3,042,019 | 7/1962 | Taylor | D7/553 X |
| 3,384,260 | 5/1968 | Buffington . | |
| 3,498,471 | 3/1970 | Dirkx | D7/550 X |
| 3,768,710 | 10/1973 | Eggers | 294/159 |
| 4,607,758 | 8/1986 | Stevens . | |
| 4,732,274 | 3/1988 | Bouton . | |
| 4,742,951 | 5/1988 | Kelly et al. . | |
| 4,848,579 | 7/1989 | Barnes et al. . | |
| 4,867,331 | 9/1989 | Task . | |
| 5,060,820 | 10/1991 | Boerner . | |
| 5,085,391 | 2/1992 | Berger et al. . | |
| 5,207,743 | 5/1993 | Costarella et al. | 220/575 X |
| 5,249,700 | 10/1993 | Dumke | 220/574 |

FOREIGN PATENT DOCUMENTS

| | | | |
|---|---|---|---|
| 0 106 626 | 4/1984 | European Pat. Off. . | |
| 1 471 281 | 3/1967 | France . | |
| 2 532 833 | 3/1984 | France . | |
| 2 592 571 | 7/1987 | France . | |
| 906 502 | 3/1954 | Germany . | |
| 33 13 369 | 1/1983 | Germany . | |
| 36 15 933.6 | 11/1987 | Germany . | |
| 92 16 491.9 | 3/1993 | Germany . | |
| 402310 | 5/1966 | Switzerland | 220/23.83 |
| 358533 | 10/1931 | United Kingdom | 220/23.83 |
| 375486 | 6/1932 | United Kingdom | D7/555 |
| 1 377 826 | 12/1974 | United Kingdom . | |
| 2 023 407 | 1/1980 | United Kingdom . | |
| WO 92/05079 | 4/1992 | WIPO . | |

*Primary Examiner*—Stephen P. Garbe
*Assistant Examiner*—Robin A. Hylton
*Attorney, Agent, or Firm*—Bacon & Thomas

[57] ABSTRACT

A mealtime aid device comprises a handle and a plurality of containers which are removably secured to the upper end of the handle.

3 Claims, 5 Drawing Sheets

FIG. 4
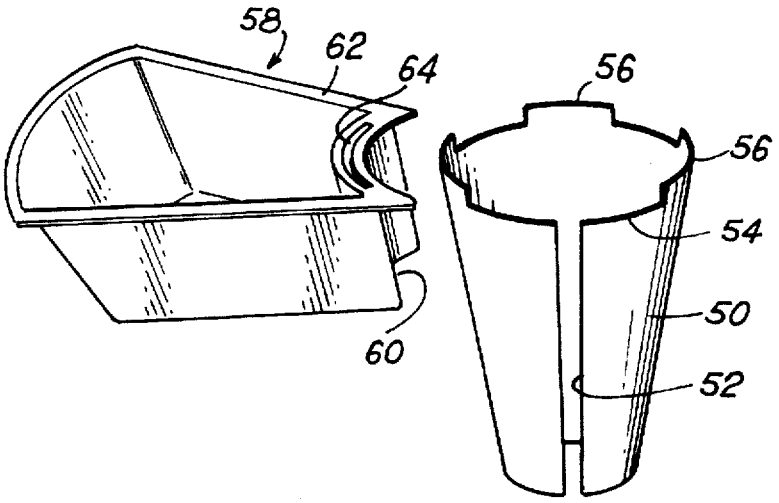
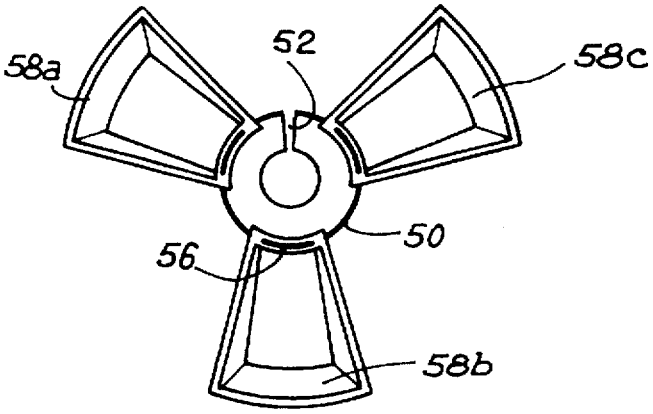
FIG. 5
FIG. 6
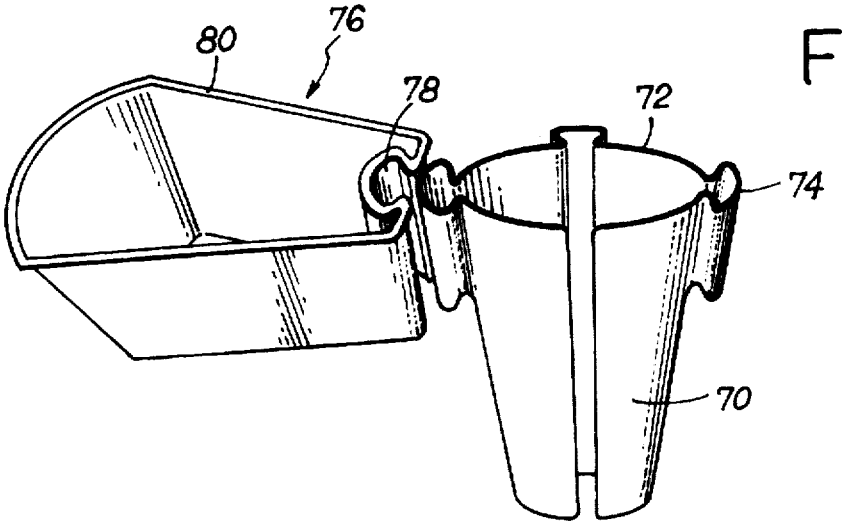

FOOD AND BEVERAGE HOLDER

The present invention has for its object a meal-taking device.

More precisely, the invention concerns a device which enables the user to hold, in one hand, preferably several containers containing various food dishes and preferably a glass, leaving the other hand free to manipulate the utensils necessary for taking this food.

This device proves very useful both at receptions where the guests are not sat down to table, for example exhibitions, parties and buffet lunches, and also in situations where the user wishes to eat, but there is no table available, and in several public places such as railway stations, trains, stadiums, cinema lines, and also quite simply in front of the television.

The term "container" used hereinafter refers to any type of object which may contain food, whatever its form or the material of which it is composed, for example, flat trays, dishes, cardboard plates, this list not, of course, being limiting.

The term "glass" used hereinafter refers to any type of object which may contain liquids, whatever its shape or the material of which it is composed, such as: glass, beaker, ice cream cones, this list not, of course, being limiting.

Several types of containers, plates, dishes, meal-trays made of food-compatible cardboard or plastic already exist on the market. It is true that all may contain food and certain may be used with a glass or beaker to eat standing or sitting down without a table.

These solutions which contribute some advantages to the consumption of meals in a table-less situation, such as a better hold on the plate or the possibility of housing or fixing a glass on the plate, nonetheless present constant drawbacks which are found in each solution, namely:

- the transmission of heat to the hand holding the container when hot food is consumed;
- the highly precarious stability of the glass when it is simply placed on the plate (problem of elevated center of gravity) even if its foot is encircled by a recess;
- the lack of balance of the plate provoked by considerable mass and weight, such as a full glass, located on its periphery;
- finally, the impossibility of reheating or cooking together the various foodstuffs requiring different cooking or heating times and others which do not need to be reheated or cooked, such as desserts.

The invention aims at bringing a solution to all the problems set forth hereinabove, namely:

- to make it possible to support at the same time and with one hand a plurality of containers and preferably a glass or a drink container, leaving the second hand free to bring the food to the mouth or to drink;
- to avoid transmission of heat between the hot containers and the carrying hand;
- to give each foodstuff complete independence either with respect to the cooking or reheating constraints or with respect to the freedom of choice of the consumer who may thus compose his/her menu by choosing independent dishes;
- consequently to improve catering made outside the appropriate establishments.

To attain this purpose, the meal-taking device according to the invention comprises means for forming a handle adapted to be gripped manually, said means extending substantially vertically, n containers intended to receive food (n>1) and securing means for temporarily connecting said n containers substantially at the upper end of the means forming a handle.

It will be understood that the containers corresponding to the food chosen may thus be simultaneously held in one hand while having the other hand available to hold the food.

According to a first embodiment, the means forming a handle define an inner recess at least open at its upper end to receive means forming glass. It is seen that, with this improved embodiment, the user has, in addition, the drink contained in a glass which is maintained vertical in suitable manner by the means forming a handle.

Moreover, as the glass is directly introduced in the means forming a handle, a very good hold of the glass is obtained since the user's hand holds the meal-taking device by this handle.

Said securing means may be formed for example in male/female manner, i.e. the bottom of the containers presents a projection (protuberance) which fits in a housing having the same perimeter as the projection and being placed on the arms fast with the central handle; or, inversely, said securing means may also be of the female/male type, i.e. the outer bottom of the containers presents a housing of shape identical to the projection which is positioned at the free end of the radiating arms; or, said securing means may be constituted by rails, for example in T-form, placed on the arms which slide in clefts appropriate for their dimensions and which are located on the bottom of the containers. The contrary situation where the rails would be placed on the bottom of the containers and the clefts on the arms may easily be envisaged. Many other means for securing these pieces exist.

According to another embodiment, the central handle may be limited to a simple cylinder or truncated cone open at its two ends, of sufficient height to be gripped and held by a carrying hand and preferably provided with a vertical slot enabling the foot of a beaker to be passed inside and housed thanks to the abutment of the beaker on the upper edge of the handle. In addition, this slot gives the handle a certain elasticity which allows the goblet to be tightened when such a container is used. The upper edge has circularly, and, of course, except at the place where the slot is located, an extension of its matter going from the periphery towards the outside, such as a ring, perpendicularly to its walls, with the result that this extension of matter may contain in its recesses other containers containing food and which are fitted in these recesses. This extension of matter substantially perpendicular to the walls of the central handle may also contain either projections predisposed to receive a housing placed on the bottom of the container, or housings or openings to receive protuberant parts placed on the bottom of the containers containing food and which are thus fixed to the central container. This embodiment may be carried out, besides by techniques adapted to plastics materials, by stamping metals as is effected for manufacturing cans for food.

According to a third embodiment, the central handle is a truncated cone open at its upper and lower ends. It is preferably provided with a vertical slot giving it a downward opening and which enables it to support a glass, as it is possible to pass the foot of the glass through this slot which also allows it to have a little flexibility in order better to hold the glass housed in this receptacle. This receptacle is provided on its upper edge with vertical tabs intended to be inserted in notches which are provided on the edge of the container placed on the face intended to abut on the side of the receptacle, so that fixation of the container to the receptacle is ensured by the clipping of these tabs in the notches and by the abutment of this same side of the container on the wall of the receptacle. The container forming the subject matter of the present embodiment, as well as all the containers described in the present text, may have all suitable shapes. It is desirable that the side intended to abut on the receptacle has a wall which follows the shape of the receptacle in the part where it touches it. Consequently, the force of gravity provoked by the container containing the food is preferably countered either by the abutment of these two walls against one another or by the tab/notch clipping system which also holds the container thanks to a lever effect.

In this latter embodiment, that side of the container intended to be positioned against the receptacle may have an inclination contrary to the inclination necessary to have the conical shape of the walls. It is therefore recommended to give a corresponding inclination to the other wall of the recipient in order that the containers be stackable. Of course, in this embodiment, as well as in the others, the container may be fixed to the receptacle in inverse manner. The downwardly directed vertical tabs are located on the edge of the face of the container which abuts against the receptacle and clip in notches located on arms of the upper edge of the handle.

According to another embodiment, the central receptacle forming the handle is designed, in its upper part, with a shape such that the perimeter presents, in certain places where it is desired to fix a container, a protuberance which exactly follows a concavity of the perimeter of the container, located, of course, on the wall of the container intended to abut on the receptacle. The container is fixed to the receptacle by sliding the concave part of the container in the protuberance of the upper wall of the receptacle. This slide of the concavity of the container in the protuberance of the receptacle stops when the small edge which surrounds the perimeter of the container arrives in abutment on the upper edge of the receptacle. This embodiment may also be designed in inverse manner. The protuberance is located on the wall of the container intended to abut against the receptacle and the concavity lies on the perimeter of the upper edge of the receptacle. In the present case, the top of the receptacle and particularly the upper part on which the containers abut, may have a different shape from the lower part where the hand grips the receptacle, which will be substantially conical. All shapes imaginable may be adapted to the containers as well as to the securing means, as the concavities and the protuberances may have various shapes provided that the protuberance is partly encircled by the concavity so as to be retained thereby in the manner of a slide block in a slide.

According to a fifth embodiment, the meal-taking device is constituted by a container intended to receive other removable containers and provided with a bottom and, in certain cases, with a lateral wall and with gripping means forming a handle, the gripping means extending substantially perpendicularly to said bottom, substantially from the center of said bottom, the length of said gripping means being sufficient to enable them to be gripped manually. The bottom comprises a central portion projecting inside said container defining an outer housing and the gripping means consist in an extension of said bottom projecting out of the outer face of said central portion and housed entirely in said outer housing.

In that case, the gripping means of the container form an integral part thereof and lie substantially in the middle of the outer face of its bottom. The bottom preferably extends from the periphery towards the center, gradually rising towards the middle in conical manner so that the handle, while being of sufficient length to be able to be gripped, preferably does not pass beyond the lowermost part of the bottom of the container, in order to give the latter, inter alia, an independent stability on a plane surface. This advantageously results in the open upper part of the handle presenting an opening whose diameter enables it to receive a beaker or a glass.

The bottom of this container may be provided with separations limiting recesses allowing housing of the other removable containers which may be secured to the container by securing means of the male/female type or vice versa or simply placed in these recesses.

According to a variant embodiment, the means forming a handle may have the shape of a truncated cone open at its upper end and closed at its lower end. In that case, the slot made in the lateral wall extends in the bottom of the handle along a radius of the bottom. This slot extends beyond the center of the bottom. The foot of the glass is thus held in the slot of the bottom of the handle.

According to a second embodiment of the invention, the means forming a handle are constituted by a can of drink of substantially cylindrical shape.

It will be understood that the containers corresponding to the chosen food may thus be simultaneously held in one hand while having the other hand available to take the food.

From the upper end of the drink can there are fixed, according to a first embodiment, extensions of its matter, preferably in the form of vertical tabs intended to be inserted in notches which are provided on the edge of the container placed on the face intended to bear on the side of the drink can, so that fixation of the container on the drink can is ensured by the clipping of these tabs in the notches and by the abutment of this same side of the container on the wall of the drink can.

The stability of the container, thus attached to the drink can, is obtained by the abutment against the drink can of the wall of the container where the notch is provided. Said wall shall, on this occasion, take a rounded shape with a concave curvature of the same dimension as the convex curvature of the drink can to allow a better stability thanks to the fit of the volumes.

According to a second embodiment, no modification is necessary on the drink can as the container is fixed to the can by clipping the space created between the edge of the container and the tongue placed on the edge of the container and which is substantially parallel to the wall of the container intended to abut against the wall of the can on the edge of the upper end of the can in the manner of a rail.

This mode of fixing the containers on the handle may also be used in the first embodiment.

Of course, in that case too, the stability of the container is obtained by abutment against the drink can of the wall of the container where the tongue is provided. On that occasion, said wall will take a rounded form with a concave curvature substantially of the same dimension as the convex curvature of the drink can to allow a better stability thanks to the fit of the volumes.

Other characteristics and advantages of the present invention will more readily appear on reading the following description of several embodiments of the invention given by way of non-limiting examples. The description refers to the accompanying Figures in which:

FIG. 4 illustrates in exploded perspective a third embodiment of the securing means.

FIG. 5 is a plan view of the embodiment of FIG. 4, the device being assembled.

FIG. 6 illustrates another embodiment of the device in exploded perspective.

Figure 1:
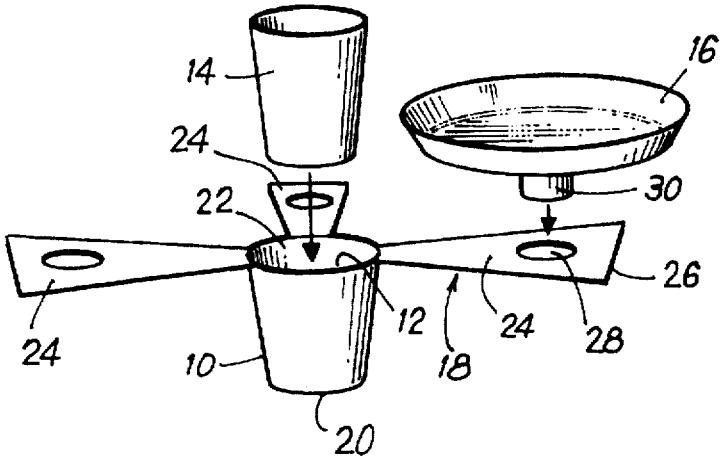
FIG. 1 is a view in perspective of the device in accordance with a first embodiment where the elements are exploded.

FIG. 1 illustrates the principle of the invention. The meal-taking device is composed of a handle 10 which preferably defines a housing 12 to receive a glass 14, a plurality of containers 16 containing food and securing means 18 between the handle 10 and the removable containers 16. According to this first embodiment, the handle 10 is slightly truncated in form. Its lower end 20 is closed while its upper end 22 is open. The securing means are constituted by radiating arms 24 fast with the upper edge of the handle 10. At their free end 26, the arms are provided with a recess 28 adapted to cooperate with a corresponding projecting part 30 provided in the bottom of the containers 16. The arms 24 preferably form one piece with the handle 10 and they are defined to ensure a rigid connection between the handle 10 and the removable containers 16.

Figure 2:
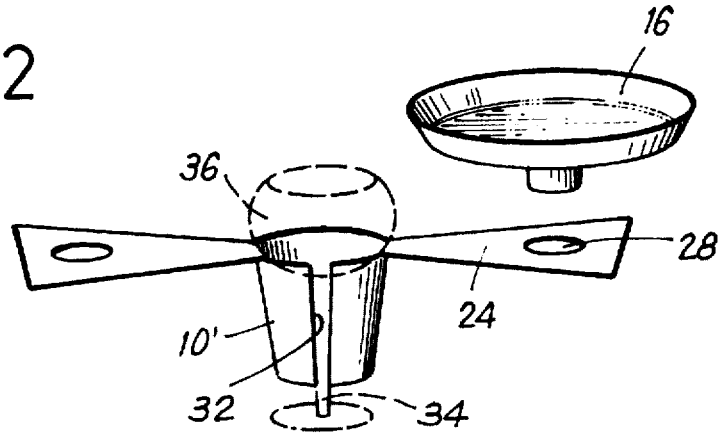
FIG. 2 is a view of the device in perspective, similar to that of FIG. 1 but provided with a vertical slot which enables it to house a item glass, passing the foot of the glass in this vertical slot.

FIG. 2 shows the securing device between the handle 10' and the containers of FIG. 1. The difference consists in the shape of the handle 10'. It is open at its two ends. Moreover, its truncated wall preferably comprises a longitudinal slot 32 extending over the whole of its length. The slot 32 has a sufficient width to allow the foot 34 of a glass 36 to pass. The glass proper is in abutment on the upper edge of the handle and the base of the foot is outside the handle.

Figure 3:
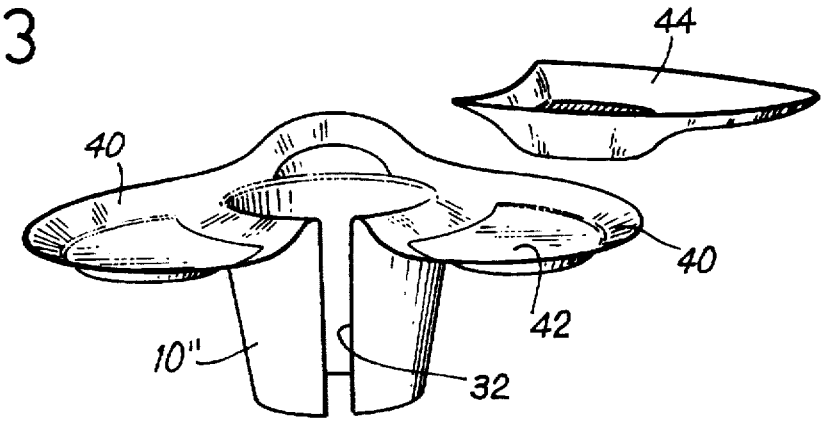
FIG. 3 is a view in perspective of a second embodiment.

FIG. 3 illustrates another embodiment where the upper edge of the handle circularly comprises, except at the place where the slot 32 is placed, an extension 40 of its matter going from the circumference towards the outside perpendicularly to its wall. These extensions of matter which may be flat and contain securing means such as notches, hooks, rails, projections or the like, are in this example advantageously hollowed out at certain places 42 to receive containers 44 which present a bottom whose shape matches these hollows.

FIGS. 4 and 5 illustrate an embodiment in which the handle 50 has the same shape as in FIG. 2 and comprises a longitudinal slot 52. The upper edge 54 of the handle is provided with vertical hooking tabs 56 regularly spaced over its periphery in a number equal to that of the containers 58 to be secured. Each container 58 comprises a wall portion 60 which may follow the outer shape of the handle 50. It also comprises a flange 62 projecting out of the container 58. This flange is provided with a slot 64 in which one of the hooking tabs 56 may penetrate. In order to secure the container 58, it suffices to engage the tab 56 in the slot 64. The surface 60 comes into abutment on the outer wall of the handle 50. FIG. 5 shows three containers **58*a*, 58*b* and 58*c* fixed on the handle 50**.

Recipients **58*a*, 58*b*, 58*c*** may consist of tins of food or other closed containers containing already-cooked food. These containers must comprise slots for hooking. The container preferably comprises, in addition to the extension comprising the slot, a second lower extension which abuts on the outer wall of the handle.

FIG. 6 shows a variant of the embodiment of FIGS. 4 and 5. The handle 70 comprises, near its upper edge 72, protuberant hooking pieces 74 which extend radially from the handle. These pieces are for example in dove-tail form. Each container 76 to be secured presents at its end for connection a recess 78 which presents a shape corresponding to that of the hooking pieces 74. The hooking pieces 74 and the recesses 78 have a sufficient length to ensure an abutment allowing a stable connection of the containers on the handle. The container 76 preferably comprises an outer flange 80. The flange 80, by bearing on the upper free edge 72 of the handle 70, ensures immobilization of the containers in the vertical direction. Of course, it may be provided that it is the container which presents the hooking piece and that it is the handle which presents the recesses of corresponding shape.

Figure 7:
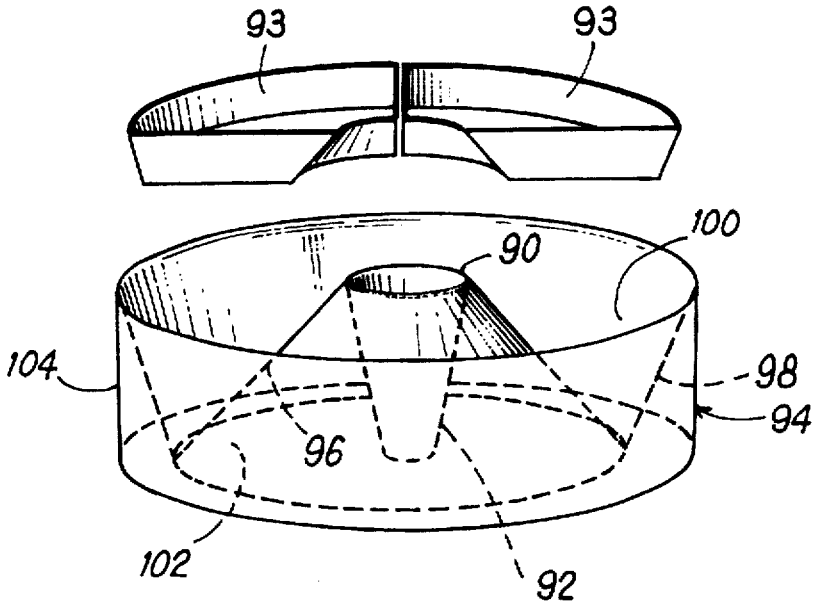
FIG. 7 shows in perspective another embodiment of the food-presenting device.

FIG. 7 shows another embodiment in which the upper edge 90 of the handle 92 is joined to a piece of revolution 94 serving to secure the removable containers 93. This piece 94 is in the form of a ring defined by a first conical surface 96 connected to a second conical surface 98 of opposite direction. These two conical surfaces define, there above, an annular space 100 adapted to receive the containers 93. The handle 92 is preferably defined by a truncated lateral wall and a bottom, the cavity thus produced being adapted to receive a beaker, the handle 92 having a central, vertically extending axis (not illustrated). The annular space may comprise radial partitions defining recesses to receive each container. In addition, the lower face of the conical surface 96 defines an annular space 102 surrounding the handle 92. This space allows the engagement of the hand around the handle 92. The piece 94 may be completed by a cylindrical skirt 104 joined to the conical surface 98.

Figure 8:
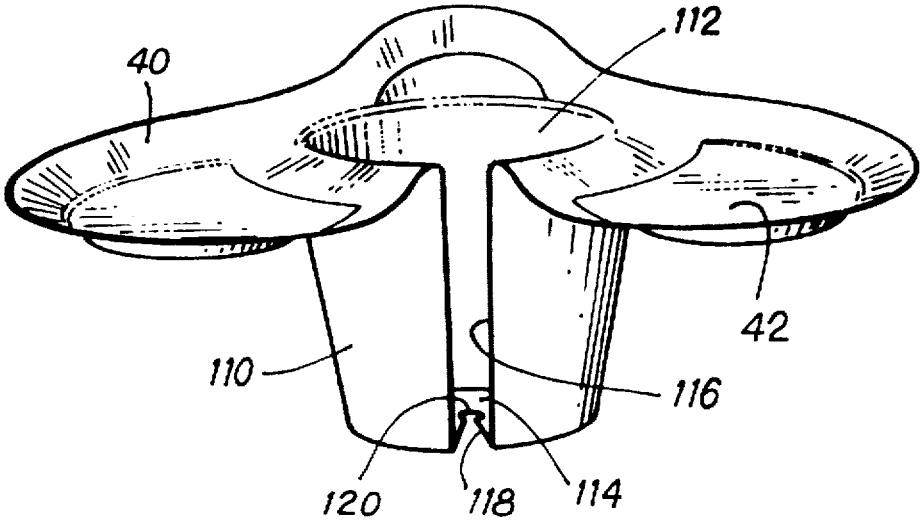
FIG. 8 shows a variant embodiment of FIG. 3.

FIG. 8 illustrates a variant of the embodiment of FIG. 3. It differs therefrom by the embodiment of the means forming a handle. The handle 110 is in the form of a conical frustum. It is open at its upper end 112 but closed by a bottom 114 at its lower end.

The slot 116 made in the lateral wall of the handle extends by a radial slot 118 made in the bottom 114. The slot 118 preferably terminates in a circular opening 120 disposed substantially at the center of the circular bottom 114 and adapted to allow the foot of the glass to pass.

It goes without saying that this embodiment of the handle may be used in the embodiments of FIGS. 2, 3, 4 and 6.

It may be envisaged, within the scope of so-called "fast-food" or "take-away" restaurants, that the containers be dispensed for example directly to car drivers who do not need to leave their vehicle to collect their meal packed in said containers.

In that case, it may be extremely practical for them that, somewhere on the vehicle, there are fixed receptacles, for example in ring form, in which the gripping means supporting these containers can be fitted. In this way, the driver or his/her passengers will have available in the vehicle the meal-taking device which may therefore be fixed in independent and removable manner for consumption in the vehicle or to be transported temporarily without a hand being needed to deal with that task.

This variant is also very useful for all consumers who, after having purchased their meals in the device, need to transport it elsewhere by using their vehicle. To that end, the means forming a handle are shaped in order to be able to be introduced in the support means such as a ring.

Figure 9:
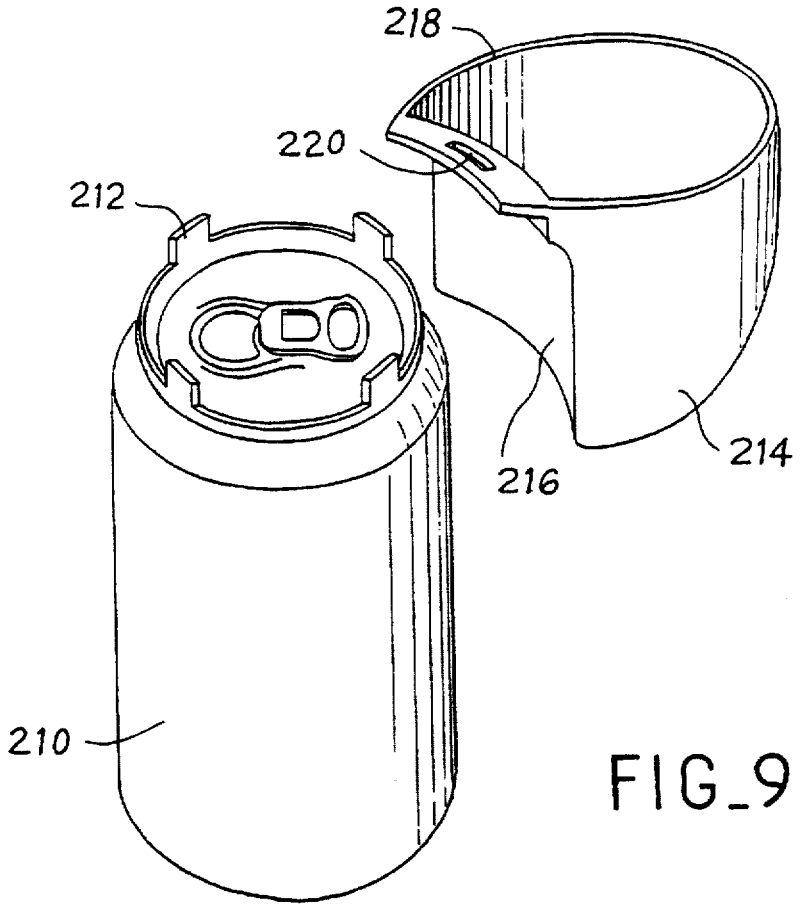
FIG. 9 is a view in perspective of the device in accordance with a first embodiment of the second embodiment where the elements are not yet secured.

FIG. 9 shows the principle of the invention in accordance with a first embodiment of the second embodiment. The meal-taking device is composed of a means forming a handle 210, constituted by a drink can of generally cylindrical shape, provided on the circular edge of its upper end with securing means, shown in this Figure by vertical hooking tabs 212 regularly distributed on its periphery in a number equal to that of the containers 214 to be secured. Each container 14 comprises a wall portion 216 which may follow the outer shape of the handle 210. It also comprises a flange 218 projecting out of the container 214. This flange is provided with a slot 220 in which may penetrate one of the hooking tabs 212. To secure the container 214, it suffices to engage the tab 212 in the slot 220. The surface 216 comes into abutment on the outer wall of the handle 210.

Figure 10:
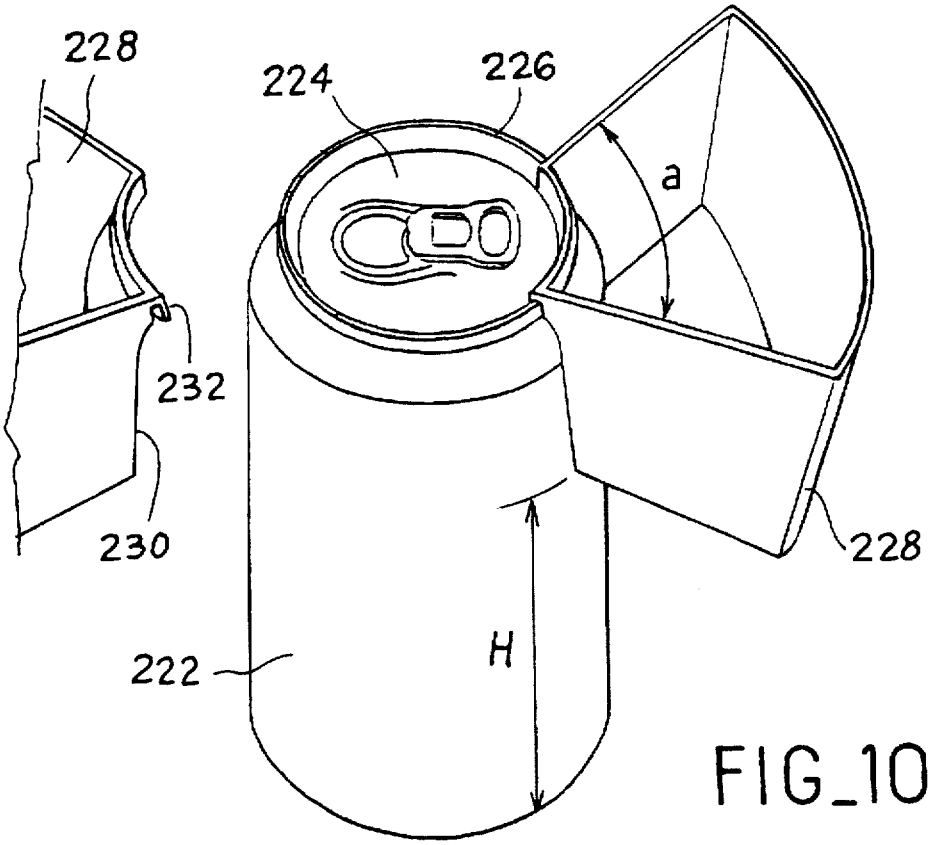
FIG. 10 is a view in perspective of the device in accordance with a second embodiment of the second embodiment, where a container, the right-hand one, is secured to the drink can and the other container is not.

FIG. 10 illustrates an embodiment in which the securing means require no modification of the drink can 222. This latter comprises, on the periphery of its upper end 224, an edge 226 projecting vertically out of the plane 224. Each container 228 comprises a wall portion 230 which may follow the outer shape of the handle 222. Each container 228 also comprises a flange 232 which projects substantially parallel to the upper part of the wall 230 and is directed downwardly. To secure the container 228 to the means forming a handle 222, it suffices to juxtapose the container 228 with respect to the means forming a handle 222 keeping the container slightly higher than the upper end of the means forming a handle 222, so that the flange 232 is a little higher than the edge 226, then to slide the container 228 downwardly, taking care that the edge 226 fits correctly in the flange 232.

The device comprises n containers, each container preferably corresponding to an angle at the center of 360/n. In a variant, the containers may have angles at the center of different value, the sum of the angles at the center being able to be equal to 360°.

Figure 11:
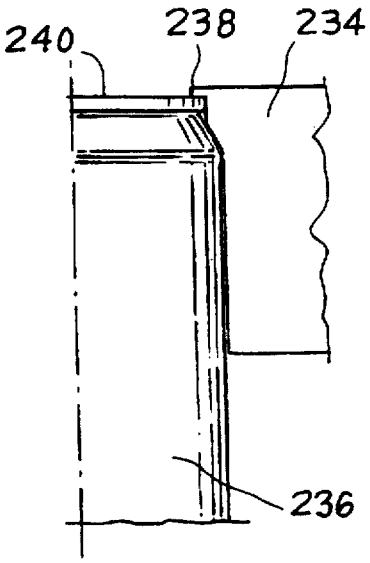
FIG. 11 is a view in transverse section of the second embodiment.

FIG. 11 shows, in a view in transverse section, a container 234 secured to the means forming a handle 236, in accordance with this second embodiment, where the flange 238 of the container is seen partially, which, like a slide block, is engaged on its rail represented by the edge 240 of the upper end of the means forming a handle.

Figure 12:
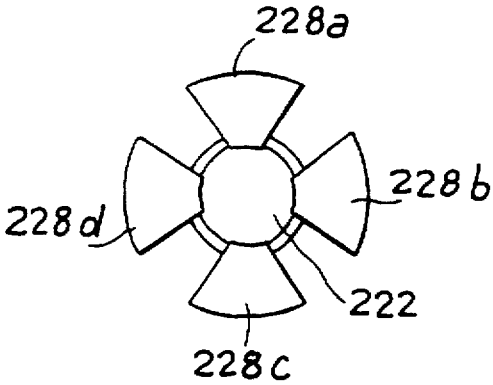
FIG. 12 is a plan view of the second embodiment.

FIG. 12 shows, in plan view, four containers 228*a*, 228*b*, 228*c* and 228*d* secured to the means forming a handle.

Figure 13:
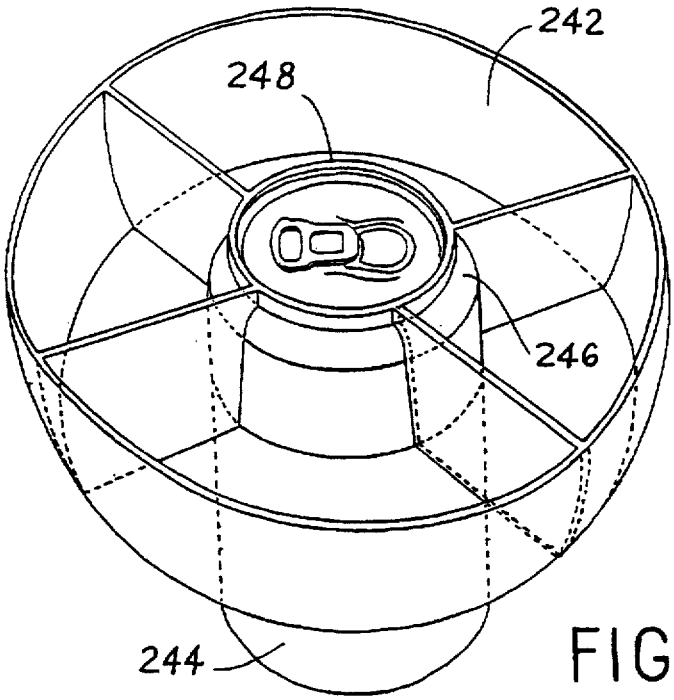
FIG. 13 is a view in perspective of a variant embodiment.

FIG. 13 illustrates in perspective a variant in which the securing means 242 develop all around the upper part of the drink can 244. In this representation, the securing means and the means forming a handle are secured by simple fit of a cylindrical sheath 246 in the means forming a handle 244. The upper end of the sheath is preferably bordered by a circular flange 248 which fits on the edge of the upper end of the means forming a handle like on a rail. However, such fit on the edge is not a necessity when the shape of the sheath is designed to follow the horizontal curve defined in the upper part of the wall of the drink can placed just below the upper end.

The n removable containers are disposed in the piece 42 in ring form.

The depth of each container must be determined to leave free a height H of the lateral wall of the drink can sufficient to allow it to be gripped despite the presence of the containers.

What is claimed is:

1. A meal-taking device comprising:

a means forming a handle configured to be gripped manually, said handle having a vertically extending, central, longitudinal axis and having an open upper end and a lower end and defining an inner recess open at its upper end to receive a glass;

n containers where n is greater than one, arranged to receive foods, each container including a bottom and a lateral wall, and securing means for temporarily securing each one of said n containers at said upper end of the handle means;

said securing means comprising a ring formed by a pair of conical surfaces converging and being connected together at a position below the upper end of said handle and radially spaced therefrom, one of said conical surfaces being connected at a smaller end thereof to the upper end of the handle.

2. A meal-taking device as claimed in claim 1, including a piece of revolution connected to a wider end of the other end of said conical surfaces, said piece of revolution extending vertically and generally parallel to the handle axis.

3. Meal-taking device according to claim 1, including a piece of revolution, said piece of revolution defining a housing arranged to receive the n containers and said securing means.

* * * * *